US008925264B2

(12) United States Patent
Thrush et al.

(10) Patent No.: US 8,925,264 B2
(45) Date of Patent: Jan. 6, 2015

(54) FLOOR TILES WITH HYBRID INTERLOCKING SYSTEM

(75) Inventors: Bruce Thrush, San Juan Capistrano, CA (US); John Grimm, Santee, CA (US)

(73) Assignee: Parallax Group International, LLC, San Juan Capistrano, CA (US)

( * ) Notice: Subject to any disclaimer, the term of this patent is extended or adjusted under 35 U.S.C. 154(b) by 0 days.

(21) Appl. No.: 13/467,775

(22) Filed: May 9, 2012

(65) Prior Publication Data

US 2012/0304566 A1 Dec. 6, 2012

Related U.S. Application Data

(60) Provisional application No. 61/484,089, filed on May 9, 2011.

(51) Int. Cl.
*E04F 15/00* (2006.01)

(52) U.S. Cl.
USPC ..... 52/177; 52/588.1; 52/591.4

(58) Field of Classification Search
CPC ..... B29C 45/14811; E04B 1/6179; E04F 2201/095–2201/096; E04F 2203/06
USPC ..... 52/390, 392, 533, 534, 539, 553, 578, 52/582.1, 586.1, 586.2, 588.1, 589.1, 52/590.1–590.3, 591.1–591.3, 571.4, 52/591.5, 592.1, 592.2, 592.4; 403/334, 403/345, 364–368, 372, 375, 376, 381
See application file for complete search history.

(56) References Cited

U.S. PATENT DOCUMENTS

| | | | | |
|---|---|---|---|---|
| 1,361,501 | A | 12/1920 | Schepmoes | |
| 4,018,025 | A | 4/1977 | Collette | |
| 4,287,693 | A | 9/1981 | Collette | |
| 5,630,304 | A | 5/1997 | Austin | |
| 5,775,046 | A | 7/1998 | Fanger et al. | |
| 5,791,114 | A | 8/1998 | Mandel | |
| 6,098,354 | A | 8/2000 | Skandis | |
| 6,363,677 | B1 | 4/2002 | Chen et al. | |
| 6,526,705 | B1 | 3/2003 | MacDonald | |
| 6,751,912 | B2 * | 6/2004 | Stegner et al. | 52/177 |
| 6,820,386 | B2 * | 11/2004 | Kappeli et al. | 52/591.4 |
| 7,284,757 | B2 | 10/2007 | Geissler | |
| 7,303,800 | B2 * | 12/2007 | Rogers | 428/44 |
| 7,340,865 | B2 * | 3/2008 | Vanderhoef | 52/177 |
| 7,516,587 | B2 | 4/2009 | Barlow | |

(Continued)

FOREIGN PATENT DOCUMENTS

GB 2277540 11/1994

OTHER PUBLICATIONS

"Tuff-Seal Advanced Interlocking Floor Tile", allMATS.com, http://www.allmats.com/site/439205/page/875709.

(Continued)

*Primary Examiner* — William Gilbert
*Assistant Examiner* — Alp Akbasli
(74) *Attorney, Agent, or Firm* — Fish & Tsang LLP

(57) ABSTRACT

A floor tile system for protecting a substrate is described. The system includes two tiles or mats that interlock with one another along numerous axes to provide a tight, high-strength seam. Specifically, the tiles include teeth that interlock with teeth of the other tile in a side-by-side manner. The tiles also include male and female portions that interlock when the tile edges overlap with one another.

12 Claims, 2 Drawing Sheets

(56) References Cited

U.S. PATENT DOCUMENTS

| | | | | |
|---|---|---|---|---|
| 7,797,890 | B2 * | 9/2010 | Thrush et al. | 52/177 |
| 7,849,642 | B2 * | 12/2010 | Forster et al. | 52/177 |
| 8,037,648 | B2 * | 10/2011 | Vanderhoef | 52/177 |
| 8,307,600 | B2 * | 11/2012 | Heartsfield | 52/582.1 |
| 8,534,023 | B2 * | 9/2013 | Zhu et al. | 52/588.1 |
| 2002/0119275 | A1 | 8/2002 | Williamson | |
| 2002/0189176 | A1 * | 12/2002 | Stegner et al. | 52/177 |
| 2003/0093964 | A1 * | 5/2003 | Bushey et al. | 52/592.1 |
| 2004/0182036 | A1 * | 9/2004 | Sjoberg et al. | 52/592.1 |
| 2004/0211143 | A1 * | 10/2004 | Hanning | 52/578 |
| 2004/0226242 | A1 | 11/2004 | Moller, Jr. | |
| 2005/0166513 | A1 * | 8/2005 | Vanderhoef | 52/578 |
| 2005/0183370 | A1 | 8/2005 | Cripps | |
| 2007/0199257 | A1 | 8/2007 | Thrush et al. | |
| 2012/0240506 | A1 * | 9/2012 | Zhu et al. | 52/588.1 |

OTHER PUBLICATIONS

Newage, "VersaTile—Revolutionize Your Floor", NewAge VersaTile brochure.

* cited by examiner

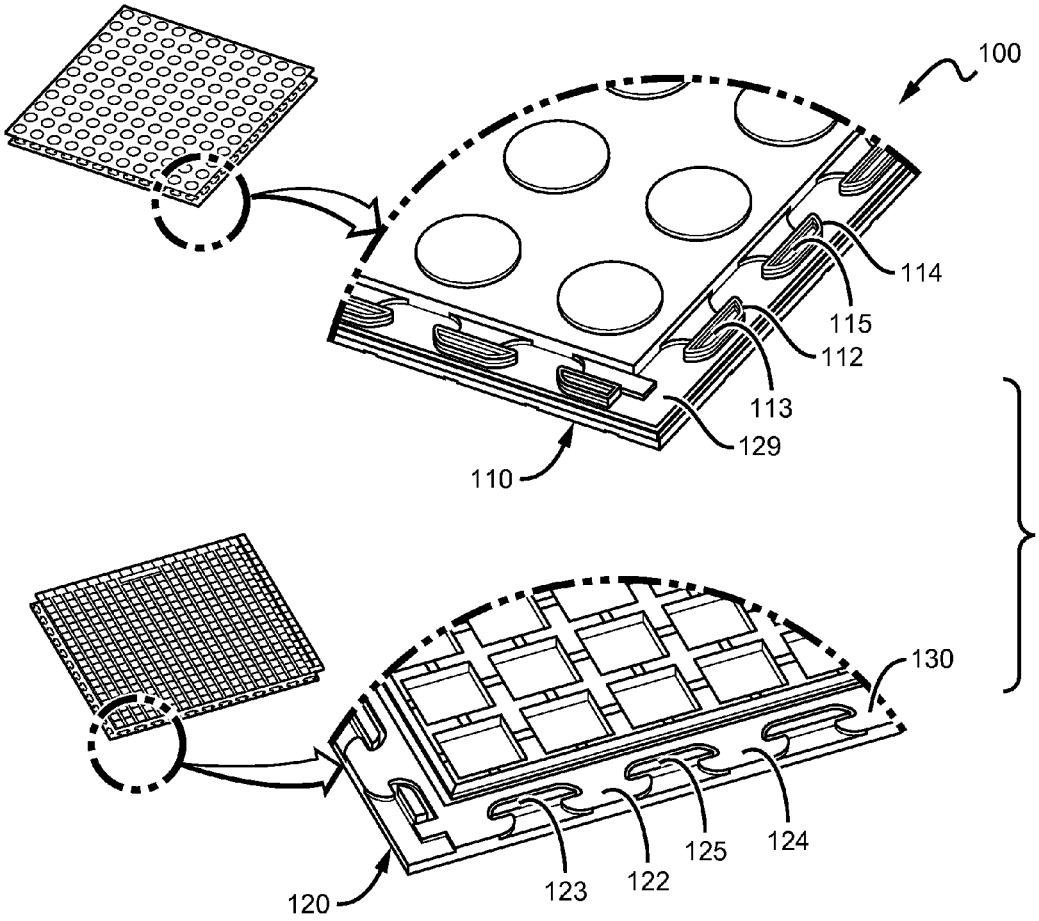
FIG. 1
FIG. 4
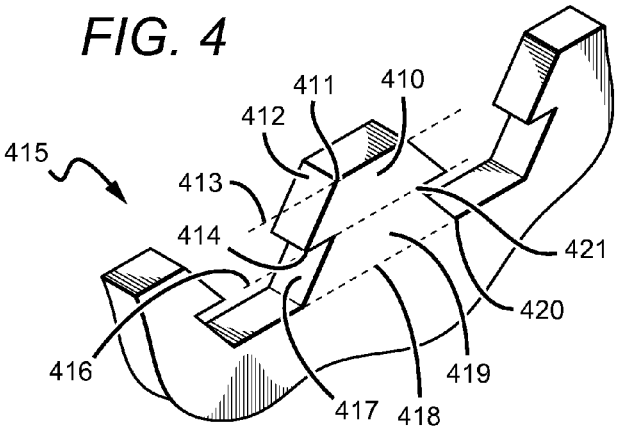
FIG. 5
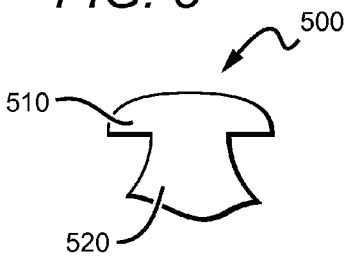

FLOOR TILES WITH HYBRID INTERLOCKING SYSTEM

This application claims the benefit of priority to Application Ser. No. 61/484,089, filed on May 9, 2011. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is modular floor tiles.

BACKGROUND

Interlocking modular tiles provide a quick and easily installable option to cover floors or other surface areas. The tiles provide a protective layer, while in some cases enhancing appearance. One problem that arises with interlocking modular tiles is the difficulty with which the tiles can be aligned during installation.

For example, the floor tiles of U.S. Patent Application No. 2005/0183370 (pub. August 2005) to Cripps use interlocking channels instead of teeth to connect adjacent tiles. These channels lack necessary structure to properly align the tiles during installation, which can add to the time and cost of installation. In addition, the channels provide only a single interlock between connected tiles, which can prevent a tight interlock between tiles and lead to uneven or unsafe surfaces.

To facilitate alignment of the tiles during installation, U.S. Patent Appl. No. 2003/0093964 (pub. May 2003) to Bushey, et al. describes a flooring assembly that has a plurality of projections that mate with a plurality of recesses on an adjacent tile. However, the Bushey tile fails to create sufficient interlock (both in terms of forming a tight seam and in terms of providing a lock that requires a large separation force) between the tiles to withstand heavy use. In addition, the Bushey tile lacks a track or other structure to help prevent water ingress, and is therefore susceptible to water seeping beneath the tiles, leading to mold or other problems.

U.S. Pat. No. 6,526,705 to MacDonald has a plurality of engagement members that help align the tile during installation, and has a recess that can create a fluid seal when mated with a projection of another tile. However, the MacDonald tile still fails to create strong interlock between the tiles.

Thus, there is still a need for a modular floor tile having teeth that provide an additional interlock between connected tiles.

SUMMARY OF THE INVENTION

The inventive subject matter provides apparatus, systems and methods in which a floor tile system includes at least two tiles that interlock with one another via teeth extending from the edge of the tiles. In addition to the interlocking teeth, each tile also has male and female portions extending upwards and downwards from the major surfaces of the tiles. The male and female portions are sized, dimensioned, and positioned on two tiles such that they engage one another to form a second interlocking between the two tiles.

In some embodiments, the teeth comprise a cap and a stem that form the general shape of a mushroom. In other aspects of some embodiments, the male portions extend upward from a major surface (or a ledge) of the first tile and the female portions (e.g., cavities) extend downward, or into, the teeth caps of the second tile. In yet other aspects, the first and second tile edges have ledges that overlap one another such that the male and female portions engage each other (e.g., the ledges sandwich the male and female portions).

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1 is a perspective view of a first tile and a second tile with hybrid interlocking features.

FIG. 4 is a perspective view of one embodiment of a tooth for an interlocking tile.

FIG. 5 is a side view of another embodiment of a tooth for an interlocking tile.

DETAILED DESCRIPTION

Figure 2:
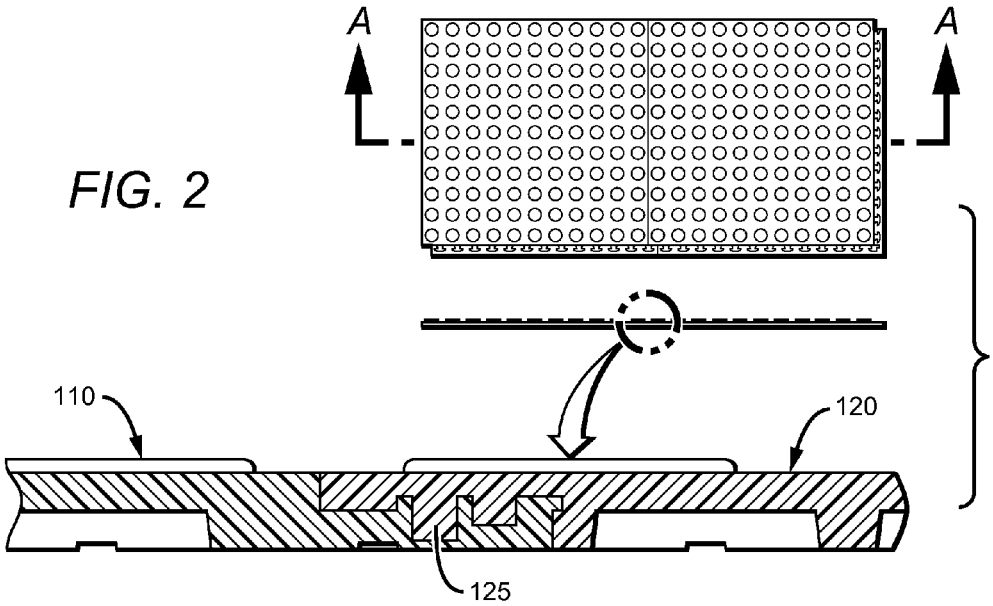
FIG. 2 is a cross-sectional side view of the first and second tiles of FIG. 1 in an interlocked state.

One should appreciate that the disclosed techniques provide many advantageous technical effects including protecting floors with interlocking floor tiles.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIG. 1 shows a floor tile hybrid interlocking system 100. System 100 includes a first tile 110 and a second tile 120. Tile 110 has a first tooth 112 and a second tooth 114 and tile 120 has a first tooth 122 and a second tooth 124. Teeth 112, 114 interlock with teeth 122, 124 in a side-by-side fashion to provide a first interlocking means for coupling tiles 110 and 120. A second interlocking means is provided by male and female portions that interlock in an overlapping fashion (as opposed to a side-by-side arrangement), as will now be described in more detail.

The teeth on tile 110 each comprise a cap portion and a stem portion, as best illustrated in FIG. 5 (see cap 510 and stem 520 of tooth 500). Each cap includes a female portion (see cavity 113 and cavity 115) configured to receive a male portion on the ledge of tile 120 (see ledge 130 and male portions 123, 125) when ledge 130 of tile 120 overlaps ledge 129 of tile 110. Male portions 123, 125 "extend" from ledge 130. As used herein, the term "extends from" means protruding in a direction away from something, either normally (perpendicularly) or otherwise. The hybrid interlocking features shown in FIG. 1 allow for interlocking along different axes (side-to-side, top-to-bottom). Mating of the female portions and the male portions advantageously provide a second interlock, which produces additional strength to the coupling between the first and second tiles.

It is further contemplated that the female portions could face upwards or downwards, and of course the mating male portions would then face in the opposite direction. In the embodiments shown in FIG. 1, the female portions happen to face downwards (from a major surface of tile 110, i.e., the top surface of tile 110), although if the tiles were turned upside down then the same figures would show the female portions facing upwards. It is also contemplated that some female portions could face upwards while others face downwards, as long as the corresponding male portions are still oriented to affect a proper mating.

Teeth comprising caps and stems advantageously provide a means for aligning two tiles with respect to one another to facilitate installation and interlocking. The stems and caps shown in FIG. 1 have been specifically sized and dimensioned (e.g., the caps have been specifically distanced from the edge of the tile body by stems) to improve and assist in alignment.

Floor tiles contemplated herein preferably have an upper or a lower ledge along each edge. When adjacent tiles are mated, the upper and lower ledges sandwich the mating of the male and female portions, thereby achieving a flush and relatively waterproof seam. All suitable configurations are contemplated. For example, the first tile could comprise a ledge that underlies the female portions of the first and second teeth, and the second tile could comprise a second ledge that covers the male portions.

Each of the first and second ledges can also advantageously include a locking strip. For example, the first strip could comprise a protruding portion that is configured to mate with a receiving cavity of the second strip. The strips provide an additional interlock, and thereby improve both water resistance and locking strength at the boundaries between adjacent tiles.

Contemplated teeth can be of any commercially suitable size and dimension, but preferably have a convex curve that in cooperation with a stem forms a mushroom-shape. Examples are shown in co-pending U.S. patent application with Ser. No. 11/677,957 (pub. Aug. 30, 2007) and PCT Application with serial number PCT/US08/02335. Mushroom-shaped teeth are considered advantageous in that they reduce binding during installation.

Preferred caps have first and second relatively flat edges substantially parallel to the nearest edge of the tile body, and left and right curved portion extending between the ends of the relatively flat cap edges. Preferred stems have left and right curved portions extending between the caps and the body of the tile, thereby forming an inverted arch.

Without wishing to be limited to any particular theory or mode of action, it is contemplated that mushroom shaped teeth provide easier installation than standard teeth, while improving strength of the interlock.

Although in most instance each of the tiles will have teeth on each of its edges, it is contemplated that tiles could have one or more edges that lack teeth, or have a greater or lesser number of teeth than other sides, or smaller or larger teeth than other sides. Tiles with no teeth on one or two edges could be useful for abutting a wall, cabinet, bathtub, and so forth.

FIG. 2 shows a side cross sectional view of tiles 110 and 120, with the male and female portions engaged with one another.

Figure 3:
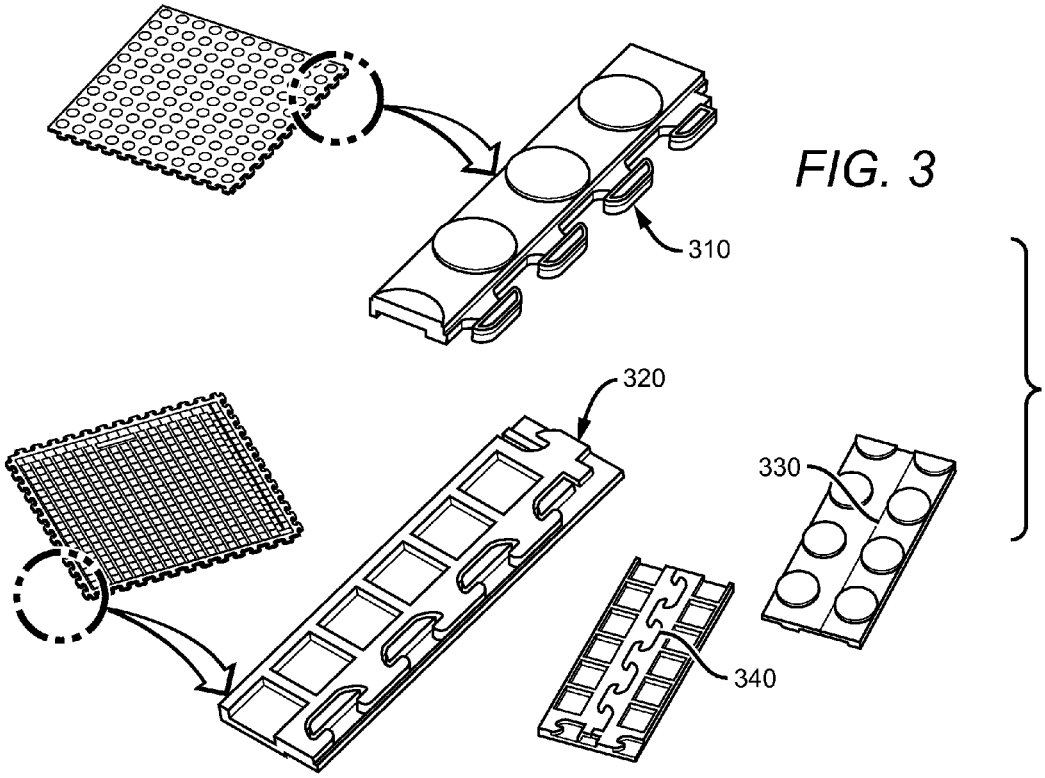
FIG. 3 is a perspective view of a first strip and a second strip with hybrid interlocking features.

FIG. 3 shows a perspective view of interlocking strips 310 and 320 in both an interlocked state and a disengaged state. Strips 310 and 320 have similar hybrid interlocking features as tiles 110 and 120 except that strip 310 has no ledge. FIG. 3 includes several perspective views showing first and second major surfaces (e.g., top and bottom surfaces) of strips 310, 320. Top seam 330 is substantially straight whereas bottom seam 340 is curved and shows the mushroom shape of the teeth.

FIG. 4 shows an alternative embodiment of a floor tile. Tile 415 includes a cap 410 that has a tooth comprising a cap 410 and a stem 419. Cap 410 has an outer edge 412 that makes an angle 411 with the top surface of cap 410 and an angle 414 with stem 419. Top Region 413 of cap 410 is substantially parallel with edge of tile 415. Inner edge 417 of step 419 makes an angle 421 with cap 410 and an angle 420 with the body of the tile. Cap 410 has first and second relatively flat edges substantially parallel to the nearest edge of the tile body, and left and right relatively flat portions extending between the ends of the relatively flat cap edges. Stem 419 has left and right relatively flat portions extending between the caps and the body of the tile.

Floor tiles typically have texturing or other patterns on the top and bottom surfaces. In a further aspect of the inventive subject matter, the bottom pattern can have sufficiently deep grooves to allow significant air flow within the pattern. This is beneficial as the air flow helps to reduce moisture present beneath the tiles after installation, and thereby helps prevent mold or other problems associated with residual moisture or standing water. Patterns with deep grooves are also advantageous as they can reduce tile weight by a factor of at least 20% relative to traditional tiles.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

Preferred top surfaces have one or more raised patterns that create a non-slip surface, though tiles having smooth top surfaces are also contemplated. The patterns are preferably formed on the tiles through injection molding, and can be formed prior to, or after, the formation of the tiles. Preferred patterns are raised at least 0.04 inches from the top surfaces of the tiles, and more preferably at least 0.1 inches.

The tiles can be fabricated from any commercially suitable material(s) including, for example, polycarbonates, plastics and other polymeric materials, rubber, clay, stone, wood, recycled materials, vinyl, rubber, linoleum, resin and/or combinations thereof. Generally, a co-polymeric material is preferred for conventional flooring covering systems.

An exemplary formulation comprises PVC Resin: 32.8%; Calcium Carbonate: 24.9%; Dioctyl Phthalate: 39.8%; Lead (as lead stearate): 2.2%; Titanium Dioxide: 0.18%; Alumina: 0.11%; Benzophenone: 0.05% and dyes: 0.05%. However, specific formulations will depend on the type of use. For example, sport flooring generally endures greater use and abuse, and therefore may require less expensive and synthetic rubber polymers.

The tiles can have any commercially-suitable size and dimension. Preferred tiles have a length of at least five inches and a thickness of at least 0.25 inches, though the tiles could have any thickness such that structural integrity of the tile is maintained. Thus, for example, tiles manufactured for sporting purposes are contemplated to have a greater thickness than tiles that lack such heavy use.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A floor tile system, comprising:

a first floor tile having a first major surface, a second major surface, and a first edge;

a first tooth extending from the first edge and having a cap portion and a stem portion that are substantially mushroom-shaped;

a closed-end cavity disposed in the cap portion of the first tooth and having a depth extending perpendicular to the first major surface;

a second floor tile having a third major surface, a fourth major surface, and a first ledge;

a second tooth extending from the first ledge;

a male portion extending from the first ledge and disposed adjacent to the second tooth, wherein the male portion has a height extending perpendicular to the third major surface, and is sized and dimensioned to fill the closed-end cavity;

a first interlock between the first tooth and second tooth, wherein the first tooth and second tooth are sized, dimensioned, and positioned to interlock with one another in a side-by-side manner; and a second interlock between the male portion and closed-end cavity, wherein the male portion and the closed-end cavity are sized, dimensioned, and positioned to interlock with one another in an overlapping manner.

2. The floor tile system of claim 1, wherein the cap has a convex curve.

3. The floor tile system of claim 1, wherein the closed-ended cavity is an upward facing cavity.

4. The floor tile system of claim 1, wherein the second major surface has a grid with a plurality of raised portions configured to allow an air flow within at least a portion of the grid.

5. The floor tile system of claim 1, further comprising a second ledge extending from the first edge.

6. The floor title system of claim 5, wherein a portion of the second ledge overlaps with the second tooth when the first tooth and second tooth are in an interlocked position.

7. The floor tile system of claim 1, further comprising a third tooth extending from the first edge and a fourth tooth extending from the second edge.

8. The floor tile system of claim 7, wherein the third tooth interlocks with the second tooth and fourth tooth in a side-by-side manner.

9. A floor tile comprising:

a first major surface;

a first edge and a first ledge;

a first tooth extending from the first edge and having a cap portion and a stem portion that meet to form a shoulder, wherein the width of the stem portion at the shoulder is smaller than the width of the cap portion at the shoulder, wherein the width is defined as being parallel to the first edge;

a closed-end cavity disposed in the cap portion of the first tooth and having a depth extending perpendicular to the first major surface;

a second tooth extending from the first ledge;

a male portion extending from the first ledge and disposed adjacent to the second tooth, wherein the male portion has a height extending perpendicular to the major surface, and is sized and dimensioned to fill the closed-end cavity;

wherein the first tooth and second tooth are sized, dimensioned, and positioned to provide a side-by-side interlocking engagement with one another; and wherein the male portion and closed-end cavity are sized, dimensioned, and positioned to provide an overlapping interlocking engagement with one another.

10. The floor tile of claim 9 wherein the first edge and second edge are adjacent and further comprising:

a third edge oppositely directed from to the first edge, wherein the third edge is functionally similar to the first edge; and a fourth edge oppositely directed from the second edge, wherein the fourth edge functionally similar to the second edge.

11. The floor tile of claim 9, wherein the closed-end cavity is disposed on the cap of the first tooth.

12. The floor tile system of claim 1, wherein the cap portion has a top region that is substantially parallel to the first edge.

* * * * *